United States Patent [19]

Cohen

[11] Patent Number: 4,979,318

[45] Date of Patent: Dec. 25, 1990

[54] PRONATARY INSERT FOR HIGH-HEELED SHOES

[75] Inventor: Lee S. Cohen, Media, Pa.

[73] Assignee: The Dr. Cohen Group, Inc., Cinnaminson, N.J.

[21] Appl. No.: 353,159

[22] Filed: May 15, 1989

Related U.S. Application Data

[63] Continuation of Ser. No. 189,126, May 2, 1988, abandoned.

[51] Int. Cl.[5] ..... A43B 13/38; A43B 13/41

[52] U.S. Cl. ..... 36/43; 128/585

[58] Field of Search ..... 36/43, 44, 71; 128/581, 128/583, 584, 585, 586

[56] References Cited

U.S. PATENT DOCUMENTS

| | | | |
|---|---|---|---|
| 51,968 | 1/1866 | Plumer | 12/133 R |
| 1,055,768 | 3/1913 | Levee et al. | 36/69 |
| 1,958,097 | 5/1934 | Shaw | 128/585 |
| 2,008,207 | 8/1934 | Greenberg | 36/71 |
| 2,119,807 | 1/1936 | Farley | 36/71 |
| 2,193,704 | 3/1940 | Vaughn | 128/586 |
| 2,216,360 | 10/1940 | Sabel et al. | 128/584 |
| 2,237,945 | 4/1941 | Minor | 128/584 |
| 2,345,820 | 4/1944 | Kohn | 128/585 |
| 3,069,972 | 12/1962 | Brody | 128/595 |
| 3,309,797 | 3/1964 | Poitras | 36/80 |
| 4,188,736 | 2/1980 | Keller | 36/80 |
| 4,266,553 | 5/1981 | Faiella | 128/585 |
| 4,320,588 | 3/1982 | Sottolana | 36/43 |
| 4,346,525 | 8/1982 | Larsen | 36/69 |
| 4,435,910 | 3/1984 | Marc | 36/44 |
| 4,513,518 | 4/1985 | Jalbert | 36/44 |
| 4,517,981 | 5/1985 | Santopietro | 128/581 |
| 4,620,376 | 11/1986 | Talarico, II | 128/584 |
| 4,631,891 | 12/1986 | Hickey | 36/43 |
| 4,674,201 | 6/1987 | Weiss | 128/585 |
| 4,688,338 | 8/1987 | Brown | 36/44 |
| 4,702,255 | 10/1987 | Schenkl | 128/586 |
| 4,747,410 | 5/1988 | Cohen | 36/43 |
| 4,759,357 | 7/1988 | Allart et al. | 128/584 |

*Primary Examiner*—Steven N. Meyers

*Attorney, Agent, or Firm*—Leydig, Voit & Mayer

[57] ABSTRACT

An orthotic for use with high-heeled shoes including a transverse and longitudinal wedges for inducing pronation and mimicking the forefoot valgus.

21 Claims, 3 Drawing Sheets

PRONATARY INSERT FOR HIGH-HEELED SHOES

This is a continuation, of copending application Ser. No. 07/189,126, filed on May 2, 1988now abandoned.

TECHNICAL FIELD OF THE INVENTION

This invention relates to a pronatary, to a compensatory, protective biomechanically designed cushioned insert composed of a closed cell foam material for use with high-heeled shoes.

BACKGROUND OF THE INVENTION

The advent of the high-heeled shoe was as a fashionable dress shoe and, as such, fulfilled its purpose satisfactorily. Due to its appeal, however, over the years, it has evolved into everyday footwear, a purpose for which it was never intended. Put simply, high-heeled shoes and proper biomechanical locomotion are not complementary. High-heeled shoes violate foot physiology and the biomechanics of locomotion.

To begin with, for definitional purposes, high heeled means shoes with heels exceeding 1½ inches (3.3 cm) in length. With reference to the foot terminology used herein, the anterior is forward (toes), the posterior is rearward (the heel), the interior is medial (instep), the outside is lateral, and the bottom is plantar. The bones are designated, in order from the anterior to posterior, as phalanges (toes), metatarsals, cuneiforms, navicular, tali and calcaneus (heel) while first means medial and fifth means lateral (see FIG. 1). Hence, the first phalange is the medial most phalange bone (big toe). Joints between bones commonly are designated by the names of the two adjoining bones. For example, "the little toe joint" is the fifth metatarsal phalangeal articulation. Finally, when the foot is angled toward the medial axis is referred to as valgus, while toward the lateral axis, as the varus.

The foot inside a high-heeled shoe is held in a different position than a foot which functions in a low-heeled shoe (near normal positioning). This position is referred to as the plantar flexed position or plantar flexion. Plantar flexion describes the foot position where the foot is pointed in a downward direction, with the toes parallel to the floor. When in this position, the foot is unnaturally rigid thereby causing forces normally directed to the heel, to shift to the ball of the foot.

Locomotion, basically, involves a two-phase cycle; a weight bearing and nonweight bearing. When wearing high heels during the weight-bearing phase of the gait cycle, rigidity, as noted above, can produce potentially damaging, forced stretching of the plantar fascia and possible development of heel spurs.

When the foot is held in a plantar flexed (supinated position as described in the literature), it does not allow the body to properly absorb the impact shock generated by contact of the foot with the ground. Due to the absence of shock absorbing ability, the impact force is passed to the body from the foot through the ankle, leg, knee, up the spinal column and, ultimately, to the neck. Hence, the entire vertical skeletal system and associated musculature is affected. More specifically, the shock energy is not physiologically damped as it is in a normal heel-to-toe gait. With the impact force being concentrated on the anterior metatarsal area (ball), the foot often sustains enhanced trauma which is evidenced by a substantial increase of injuries to anterior metatarsal area.

In addition to the above-described deleterious effects, the plantar flexion creates indirect physiological complications. First, increased shock impact forces cause the calf muscles to compensate for the diminished impact damping of the foot by tightening. The tightening and increased strain on the front part of the lower leg are symptomatic of anterior shin splints (inflammation of the front, lower leg) which develop from such muscle strain. Once developed, the body attempts to decrease strain on the legs by increasing strain on the knees, which in turn, tend to flex. The hips also then, flex from the knee flexion. In combination, these reactions cause the body's center of gravity to move forward whereby the buttocks protrude and the back arches to balance the center of gravity and to maintain a standing position. It is readily appreciated that once the back arches, the entire spinal cord extending to the neck, is affected and the chest and buttocks are caused to compensate even more. In short, locomotion in high-heeled shoes creates dynamic, impact deforming forces on the body.

There are three common foot conformations. One is normal and two are deviations; forefoot and rearfoot deformities. Forefoot deformity (see FIG. 2) is generally results in abnormal subtalar joint pronation (greater than 7° forefoot varus). Plantar flexion and increased median arch height are the deforming characteristics caused by wear of high-heeled shoes. Accordingly, when combined, the problems of forefoot deformity are exacerbated where the foot is maintained in an overly rigid configuration and a constant abnormal attitude of propulsion. Thus, the lever-mobile adapter sequence of the normal gait cycle is disrupted.

Turning now to the biomechanical principals involving a normal foot (see FIG. 3) it possesses less than 7° forefoot varus and less than 5° sub-talar eversion (or inversion). The normal foot provides a lever mobile adapter sequence for the gait cycle which provides for normal locomotion, shock impact damping and is compatible with natural skeletal and muscle structure. When a normal foot is exposed to high-heeled shoes, it should be readily appreciated from the foregoing that the plantar flexion coupled with increased median arch height results. Hence, a sufficient degree of pronation, necessary to effect proper weight distribution and shock dissipation, is prevented. This, in turn, causes the discomfort and injury prone conditions of high-heeled shoes.

Finally, rearfoot deformity (see FIG. 4) causes abnormal subtalar pronation. The forefoot valgus at the metatarsal heads (greater than 5° subtalar eversion or inversion) causes the forefoot to turn towards the medial axis (pronation). Normally, the forefoot valgus is approximately 3° and extends from the lateral aspect to the medial aspect along the metatarsal parabola (the curved line defined by the metatarsal phalangeal articulation) and imparts a normal degree of pronation.

It is well known that abnormal or augmented pronation is generally undesirable. (For a more detailed explanation of the deleterious effects of abnormal pronation especially in athletics, reference is made to the inventor's patent application Ser. No. 096,239). Abnormal pronation, caused by a rearfoot deformity, is desirable to compensate for the unnatural biomechanics induced by high-heeled shoes. Since rearfoot deformity induces body weight to be transmitted through the subtalar joint in a shorter period of time, exposure of the metatarsals to those forces is minimized. As a result, there is less time for abnormal subtalar joint pronation to develop when high-heeled shoes are worn.

Previous orthoses for high-heeled shoes have been developed to make the wear more comfortable. Generally, they provide only rigid, stationary support for the foot arches without regarding biomechanical dynamics. For example, a recently issued patent, Brown, U.S. Pat. No. 4,688,338, describes a laminated orthotic for high-heeled shoes. Brown's approach is to provide a multi-layered structure of resin impregnated graphite fiber layers where the different layers possess differential geometric orientations relative to the longitudinal axis of the foot. The identified purpose of the structure is to offer a rigid platform resistive to the forces associated with high-heeled shoe wear. In Brody, U.S. Pat. No. 3,068,872 a stiff foot supporting device for a curved elliptical high-heeled (court) shoe is described. That device includes an arch portion for better supporting the arch during locomotion. Although both patents analyzed the abnormal biomechanics of locomotion, they failed to recognize the simple and elegant expedient of inducing pronation to compensate for the artificially induced deformities occasioned by high-heeled shoes.

SUMMARY OF THE INVENTION

It is an object of this invention to minimize biomechanical complications induced by the wear of high-heeled shoes.

It is another object of this invention to provide a novel structure and approach, not previously recognized, for enhancing the comfort of high-heeled shoes.

It is still another object of this invention to provide a universally applicable orthotic configured to mimic the pronatory effect of rearfoot deformity (forefoot valgus) for use with high-heeled shoes.

Yet another object of this invention is to provide a pronation inducing orthotic insert structured to overcome the detrimental effects of plantar flexion.

These and other objects are satisfied by a pronatary orthosis for use with high-heeled shoes, comprising a pad having a surface dimensioned to underlie the plantar fascia and heel of a foot. The pad is composed of a compressible and resilient material which has a load deflection of between 1–2 kg/cm$^2$, adapted to compress during the weight-bearing portion of the gait cycle and catapults the foot into the next weight-bearing portion. The orthotic incorporates an anterior pad portion for underlying the plantar fascia and metatarsal parabola, said portion defining a first transverse wedge of diminishing thickness from the lateral to medial sides and extending thereacross, a second longitudinal wedge of increasing thickness from the metatarsal parabola to the posterior line defined by the metatarsal-cuneiform articulation, where said pad resists plantar flexion by inducing pronation by stretching the plantar fascia and raising the height of the metatarsal heads to decrease the height of the median arch.

In short, the crux of the instant invention is to provide a structure mimicking rearfoot deformity, aid the foot in pronating to increase shock absorption and to catapult the foot into its next step without further excessive shock to the metatarsal area.

This invention introduces a biomechanically configured orthotic intended to artificially induce rearfoot deformity (pronation) and thereby minimize the adverse biomechanical effects caused by the wear of high-heeled shoes. To accomplish this purpose, the orthotic incorporates a flared wedge-shaped mass of resilient cushioning material extending on the anterior-posterior axis approximately 1 inch (2.2 cm) which diminishes in thickness from the posterior to the anterior direction and terminates just posterior to the metatarsal parabola. The wedge provides resistive force that is resolvable into vertical and horizontal components. The horizontal component acts to stretch the plantar fascia and the vertical component acts to raise the metatarsal bones. The combination of the plantar fascia stretching and the decrease in the height of the median arch (by raising the metatarsal bones just posterior to the metatarsal heads and anterior to the mid-tarsal joint) induces pronation which is otherwise prevented by high-heeled shoes.

The orthosis of this invention is constructed from a compressible, resilient, cushioning material which resists automatic return of the foot to the plantar flexed condition. Thus, throughout the gait cycle there is a springing action, similar to a catapulting effect, exerted in the plantar fascia and median arch.

The combined effects of the forefoot valgus and the spring loading of the plantar fascia and median arch are intended to produce increased pronation. This increase in pronation more closely mimics normal pronation and, in turn, provides more normal weight distribution and shock dissipation within the foot. Correspondingly, the orthosis relieves the discomfort and injury caused to the entire body by high-heeled shoes.

DETAILED DESCRIPTION OF THE INVENTION

Orthotic device 10 is specifically designed to compensate for foot deformity occasioned by the use of high-heeled shoes. Orthotic 10 is dimensioned to conform to the interior platform of a high-heeled shoe. Preliminarily, it should be noted that the drawings and description address an insert adapted for a right foot. Clearly, the same principals apply to the left but as a mirror image.

Figure 1:
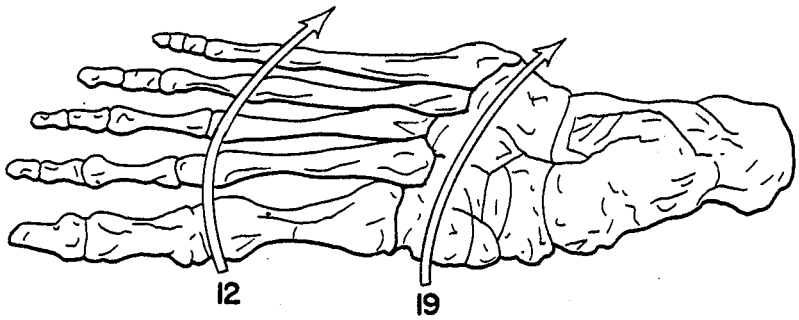
FIG. 1 is a diagram of the skeletal structure of the foot.
Figure 2:
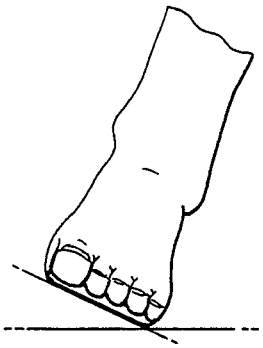
FIG. 2 is a representation of a forefoot varus deformity.
Figure 3:
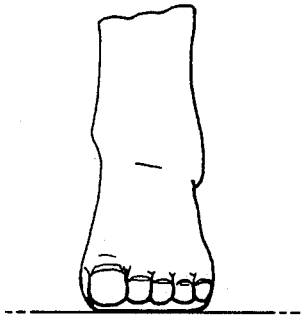
FIG. 3 is a representation of normal foot positioning.
Figure 4:
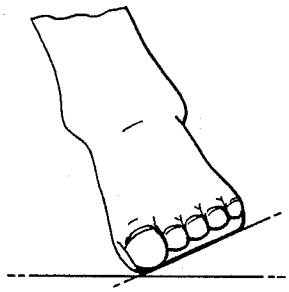
FIG. 4 is a representation of rearfoot deformity.
Figure 5:
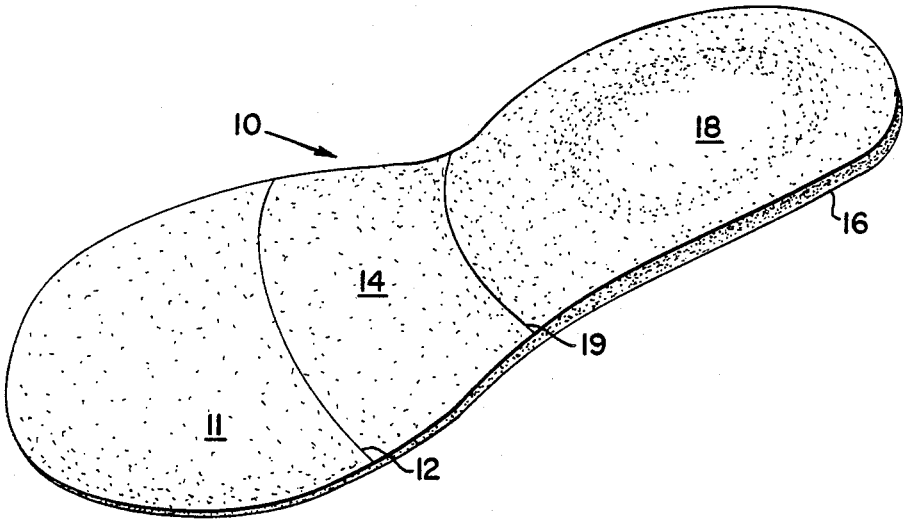
FIG. 5 is a perspective view of the invention.

Referring now to FIG. 5, anterior surface 11, underlying the toes, has a thickness of approximately ⅛ inch (0.3 cm) and is adapted to fit into the toe portion of the shoe. Line 12 represents the posterior boundary of surface 11 and defines the anterior border of middle wedge portion 14 and corresponds to the metatarsal parabola. Orthotic 10 rises at an angle of 40° from line 12 to posterior heel section 16. Posterior portion 16 contains shallow, meniscus shaped heel cup 18 (of lesser thickness than the surrounding structure) adapted to accommodate the heel of the foot comfortably and stabilize the posterior portion of orthotic 10 within a shoe.

Figure 6:
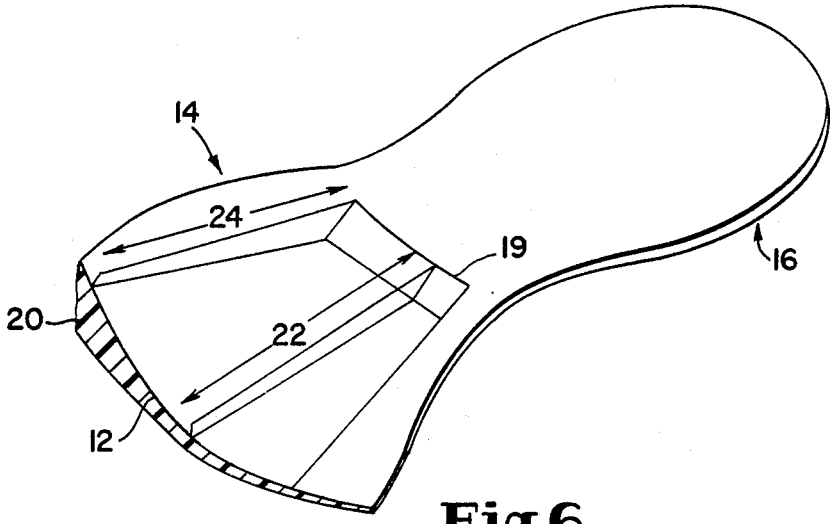
FIG. 6 is a sectional view of an orthotic according to the invention.

Turning to FIG. 6 and referring specifically to middle wedge portion 14, it extends rearwardly from line 12 the metatarsal parabola to the metatarsal-cuneiform articulation defined by line 19 (anterior of heel cup 18). Middle wedge portion 14 defines forefoot valgus wedge 20 (exaggerated for purposes of illustration). The lateral aspect of forefoot valgus wedge 20 has a thickness of 3/16 inch which gradually diminishes to ⅛ inch at the medial aspect underlying the second metatarsal head. The thickness of the orthotic remains constant at ⅛ inch from the second metatarsal head across the first metatarsal head and to the medial boundary. The substantially uniform slope of the wedge diminishing in thickness by 1/16th inch between fifth and second metatarsal head provides a slope of approximately 3°, thereby establishing an artificial forefoot valgus which contributes to a cumulative lowering of the median arch and stretching of the plantar fascia.

The longitudinal configuration of middle wedge portion 14 is described with reference to lines 22 and 24. Line 22 corresponds to and underlies the second metatarsal bone and is approximately 1 inch (2.2 cm) in length. The thickness of portion 14 along line 22 gradually diminishes from ¼ inch (0.55 cm) at line 19 to ⅛ inch (0.27 cm) at line 12. Line 24, corresponding to and underlying the fifth metatarsal, has a thickness of ¼ inch (0.55 cm) at line 19 which gradually diminishes to 3/16 inch (41 cm) at line 12 and ultimately to ⅛ inch in anterior portion 11. In other words, this wedge structure establishes a forefoot valgus posterior of the metatarsal parabola and also provides additional cushioning for the plantar fascia.

In order to provide the above-described structure and to achieve the intended cushioning as well as the desired springing (rebounding) action of the orthotic on the plantar fascia and metatarsal bones, selection of the material to be employed is critical. The present invention requires particular cushioning and resilience properties. Also, the material must possess structural integrity so as to withstand the repeated forces generated during locomotion. One material found acceptable is a closed cell foamed plastic with thermosetting properties. It is "Plastizote PO78", available from United Foam Plastics of Georgetown, Mass. "Plastizote PO78" has an original (non-thermoset) density of 4.4 lb/ft$^3$ (120 gm/cm$^3$). Alternative to the "Plastizote" is "Trocellan JV500" produced by Rogers Foam Corp. of Somerville, Mass., having an original density of 6.5 lb/ft$^3$ and a thermoset (50%) density of 8 lb/ft$^3$ (220 gm/cm$^3$). Considering the fact that these materials will be thermoset, their densities will increase. When "Plastizote PO78" has been thermoset to 50% of its original thickness, it possesses a density of 6.4 lb/ft$^3$ and compression load deflection of 19–27 lb/in$^2$ (1.3–1.9 kg/cm$^2$ (ASTM-3574-81).

A typical technique for producing orthotic 10 from such materials includes placing a sheet of ½ inch thick "Plastizote PO78" in a convection oven with both top and bottom heating elements which is preheated to a temperature of between 340° and 400° F. (170°–205° C.). Once the desired thermosetting temperature is achieved, the sheet is removed from the oven and placed in a mold corresponding to the desired contours of the insert. The mold is closed and pressure ranging from 5–10 lb/in$^2$ (0.35–0.70 kg/cm$^2$), preferably 7 lb/in$^2$ (0.5 kg/cm$^2$ at a closing speed between 40 and 400 inches per minute is applied. The mold is kept closed and then the inserts are permitted to cool for between 2 and 6 minutes prior to removal. (In the event a ventilated mold is used, the cooling time can be reduced.) An alternative method contemplates heat molding. In this case, the "Plastizote" sheet is placed directly into the mold and heated to where upon a closing pressure of up to 40 lb/in$^2$ (2.8 kg/cm$^2$) is employed. Once the molding has been completed the finished insert, as above, is removed and excess material is trimmed.

Figure 7:
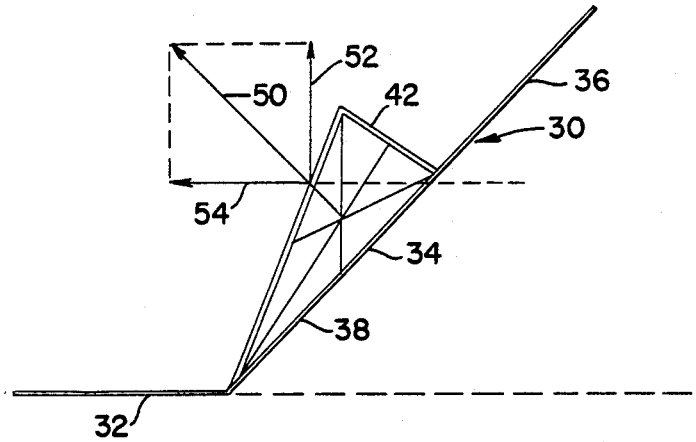
FIG. 7 is a schematic representation of the effect of the invention on locomotion forces.
Figure 8:
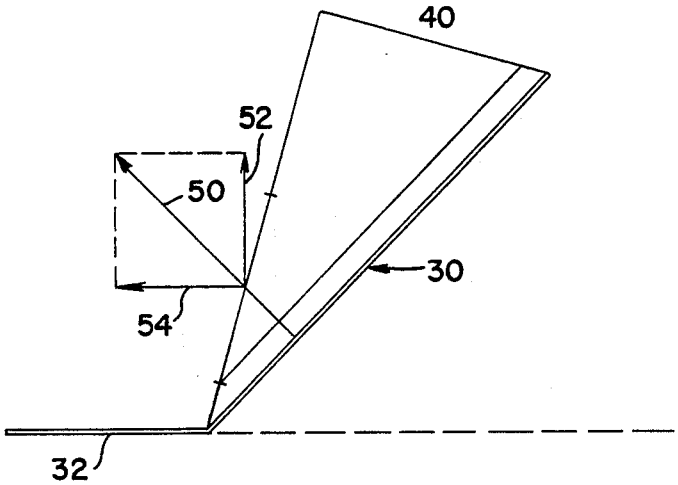
FIG. 8 is a schematic of the force redistribution.

FIGS. 7 and 8 are provided to illustrate the effect of the longitudinal wedge of the invention on force distribution relative to the foot. For purposes of simplification, transverse wedge 20 is not depicted. FIG. 7 schematically represents longitudinal wedge 42 relative to the foot. Line 30 represents the bottom of a foot. The anterior (phalangeal) portion is represented by line 32, the middle portion (plantar fascia) by line 34 and the heel by line 36. Line 38 defines the metatarsal bone which corresponds to a portion of the plantar fascia (line 34). The locus of resistive force 50 is located where the bisectors of the wedge sides intersect. Vertical force vector component 52 and horizontal component 54 are designated by arrows 52 and 54, respectively.

FIG. 8 schematically illustrates a foot with the invention and the resulting resistive forces. For purposes of clarity, wedge 42 is not illustrated. Angle 40 represents the median arch. Irrespective of the artificial height increase and catapulting effect of wedge 42 relative to the metatarsal bones (line 38), elementary biomechanical and geometric force vector analysis clearly indicates the effect of the force redistribution provided by the invention. It is noteworthy to mention that wedge 20 (the forefoot valgus) is not described with particularity here because as a practical matter, the first and second metatarsals more greatly influence the median arch and plantar fascia than do the third through fifth metatarsals. Given the greater contribution coupled with the fact that wedge 20 turns the foot medially from the lateral aspect as well as effectively lowering the median arch, the principal force distribution occurs along the first and second metatarsals. The redistribution of the force across the foot combined with the compressive resiliency of the orthotic and the transverse, pronatory wedge contribute to the biomechanically beneficial effect of the invention when used with high-heeled shoes.

In summary, a standardized insert for use with high-heeled shoes is provided with features a wedge structure intended to induce pronation and mimic the effects of rearfoot deformity while also providing a longitudinal wedge which contributes to beneficial force redistribution.

The insert may be modified to include conventional characteristics. For example, it may be coated or combined with a textile or fabric layer on its upper surface for comfort and cosmetic reasons. Other such variations or known techniques and materials may be used to improve or modify the basic invention as should now be apparent from the foregoing. Such variations and modifications now being evident to the skilled artisan, are contemplated to fall within the intent and scope of the invention now defined by the following claims.

I claim:

1. A pronatary orthotic for use with high-heeled shoes, comprising:

a pad having a surface dimensioned to underlie the plantar fascia and heel of a foot, said pad being composed of a compressible and resilient material having a load deflection of approximately 1.3–1.9 kg/cm$^2$, an anterior pad portion for underlying the plantar fascia and metatarsal parabola, said portion defining a first transverse wedge extending and having a diminishing thickness from the medial to lateral to medial sides, a second longitudinal wedge of increasing thickness and extending from the line corresponding to the metatarsal parabola to the line corresponding to the metatarsal cuneiform articulation and adapted to underlie the plantar fascia, said pad resisting plantar flexion by inducing pronation by stretching the plantar fascia and raising the height of the metatarsal heads to decrease the height of the median arch, said pad also being deformable during the weight-bearing portion of the gait cycle and upon release of the weight catapults the foot by reorienting to its original uncompressed configuration.

2. An orthotic according to claim 1 where the second longitudinal wedge is approximately an inch in length.

3. An orthotic according to claim 2 where the pad is composed of a thermoset closed cell foam material having a thermoset density ranging between 6.4–8 lb/ft$^3$.

4. An orthotic according to claim 3 where the thickness of the transverse wedge on the lateral side is 3/16 inch and the thickness diminishes to ⅛ inch on the medial side.

5. An orthotic according to claim 4 where the thickness of the longitudinal wedge increases by ⅛ inch.

6. An orthotic according to claim 5 where the orthotic is combined with a textile cover to maximize comfort.

7. An orthotic for use with high-heeled shoes, comprising:

a pad dimensioned to underlie a portion of a foot and extend from the metatarsal parabola to the metatarsal cuneiform articulation, said pad being composed from a resilient, compressible material having sufficient structural integrity to rebound to its original configuration immediately following release of compressive forces, a transverse wedge extending from the lateral to medial side and possessing uniformly diminishing thickness from the area underlying the fifth metatarsal to the second metatarsal, and a longitudinal wedge of increasing thickness extending from the metatarsal parabola to the metatarsal cuneiform articulation.

8. An orthotic according to claim 7 where the second longitudinal wedge is approximately an inch in length.

9. An orthotic according to claim 8 where the pad is composed of a thermoset closed cell foam material having a thermoset density ranging between 6.4–8 lb/ft$^3$.

10. An orthotic according to claim 9 where the thickness of the transverse wedge on the lateral side is 3/16 inch and the thickness diminishes to ⅛ inchon the medial side.

11. An orthotic according to claim 10 where the thickness of the longitudinal wedge increases by ⅛ inch.

12. An orthotic according to claim 11 where the orthotic is combined with a textile cover to maximize comfort.

13. A pronatary orthotic for use with high-heeled shoes, comprising:

a pad having a surface dimensioned to substantially underlie the plantar fascia, said pad being composed of a compressible and resilient material, an anterior pad portion defining a first transverse wedge extending and having a diminishing thickness from the lateral to medial sides, a second longitudinal wedge of increasing thickness and extending from the line corresponding to the metatarsal parabola to the line corresponding to the metatarsal cuneiform articulation and adapted to underlie the plantar fascia, said pad resisting plantar flexion by inducing pronation by stretching the plantar fascia and raising the height of the metatarsal heads to decrease the height of the median arch, said pad also being deformable during the weight-bearing portion of the gait cycle and upon release of the weight catapults the foot by reorienting to its original uncompressed configuration.

14. An orthotic according to claim 13 where the pad is composed of a thermoset closed cell foam material having a thermoset density ranging between 6.4–8 lb/ft$^3$ and a load deflection of 1.3–1.9 kg/cm$^2$.

15. An orthotic according to claim 13 where the orthotic is combined with a textile cover to maximize comfort.

16. An orthotic structure for inducing pronation, comprising:

an orthosis dimensioned to underlie the plantar facia between the metatarsal parabola and metatarsal cuneiform articulation of a foot, said orthosis incorporating a transverse wedge of diminishing thickness from the lateral to medial sides and a longitudinal wedge having minimal thickness at that portion underlying the metatarsal parabola and increasing thickness under the plantar facia to maximum thickness under the metatarsal-cuneiform articulation.

17. An orthotic according to claim 16 where the orthotic is an insertable pad formed of resilient, compressible thermoset closed cell foam thermoplastic having a density of 6.4–8 lb/ft$^3$ and further includes a heel cup.

18. An orthotic according to claim 17 further comprising a fabric layer formed on the upper surface of said pad.

19. An orthotic comprising:

a resiliently deformable compressible element incorporating pro-pronatary means for establishing a forefoot valgus and for stretching the plantar fascia, where said compressible element is an insertable pad formed from thermoset foam material and is dimensioned for use with a high-heeled shoe, where said pro-pronatary means is a transverse wedge and a longitudinal wedge, where the transverse wedge is of diminishing thickness from the lateral to medial sides of the pad in the region of the pad underlying the metatarsal parabola and where the longitudinal wedge increases in thickness and extends from a line corresponding to the metatarsal parabola to a line corresponding to the metatarsal cuneiform articulation.

20. An orthotic according to claim 19 further comprising an absorbent textile covering on the pad.

21. An orthotic comprising:

a resiliently deformable compressible element incorporating pro-pronatary means for establishing a forefoot valgus and for stretching the plantar fascia, where said pro-pronatary means is a transverse wedge and a longitudinal wedge where the transverse wedge is of diminishing thickness from the lateral to medial sides of the pad in the region of the pad underlying the metatarsal parabola and the longitudinal wedge increases in thickness and extends from a line corresponding to the metatarsal parabola to a line corresponding to the metatarsal cuneiform articulation.

* * * * *